US005686163A

United States Patent [19]

Tsubata et al.

[11] Patent Number: 5,686,163

[45] Date of Patent: Nov. 11, 1997

[54] SURFACE FASTENER

[75] Inventors: Noritaka Tsubata; Mitsuhisa Okawa, both of Toyama-ken, Japan

[73] Assignee: YKK Corporation, Tokyo, Japan

[21] Appl. No.: 670,936

[22] Filed: Jun. 27, 1996

[30] Foreign Application Priority Data

Jun. 30, 1995 [JP] Japan ..... 7-165434

[51] Int. Cl.[6] ..... B32B 5/08

[52] U.S. Cl. ..... 428/99; 428/100; 428/120; 24/442; 24/446

[58] Field of Search ..... 428/99, 100, 120; 24/445, 446, 443, 442

[56] References Cited

U.S. PATENT DOCUMENTS

| | | | |
|---|---|---|---|
| 3,464,094 | 9/1969 | Mates | 24/204 |
| 5,081,748 | 1/1992 | Eberle | 24/442 |
| 5,105,520 | 4/1992 | Eberle . | |
| 5,178,923 | 1/1993 | Andrieu et al. | 428/36.1 |

FOREIGN PATENT DOCUMENTS

| | | |
|---|---|---|
| 0 310 784 | 12/1989 | European Pat. Off. . |
| 54-102305 | 7/1979 | Japan . |
| 59-68410 | 5/1984 | Japan . |
| 6-37710 | 11/1988 | Japan . |

*Primary Examiner*—Alexander Thomas
*Attorney, Agent, or Firm*—Hill, Steadman & Simpson

[57] ABSTRACT

A surface fastener including a woven fabric having a number of interlocking elements projecting from one surface of said woven fabric, at least two round cords disposed adjacent to the interlocking elements and woven at regular intervals as the woven fabric are woven in such a condition that the round cords are longitudinally tensed and have a smaller height than the interlocking elements and are disposed in an exposed condition on the surface of the woven fabric. And flat attachment portions devoid of interlocking elements are disposed in juxtaposition with the round cords on outer sides of the round cords opposite to the interlocking elements. A number of round cords may be disposed on the woven fabric. The thus woven round cords are made rigid and highly resistant to compression or crush. With the round cords thus provided, the interlocking elements can provide a great fastening force over a prolonged period of use. By virtue of the flat attachment portion, the surface fastener can be readily attached by sewing to an article.

11 Claims, 4 Drawing Sheets

SURFACE FASTENER

BACKGROUND OF THE INVENTION

1. Field of the Invention

The present invention relates to a surface fastener capable of preventing a crushing of interlocking elements, such as loops or hooks, under pressure exerted by ironing, for example.

2. Description of the Prior Art

Japanese Utility Model Laid-open Publication No. SHO 54-102305 discloses a conventional surface fastener composed of male and female fastener parts each including, as shown here in FIG. 6, a pair of waterproof members of synthetic resin or rubber woven into a foundation fabric along opposite longitudinal edges thereof to form thick and bulky woven longitudinal edge portions so as to provide a waterproofing design to the surface fastener.

Another conventional surface fastener disclosed in Japanese Utility Model Laid-open No. SHO 59-68410 includes, as shown here in FIG. 7, a pair of woven or knitted core members attached as bank-like projections sewn to opposite longitudinal edges of a foundation fabric of a female fastener part including a mass of loop-like interlocking elements implanted into the foundation fabric.

Japanese Utility Model Publication No. HEI 6-37710 discloses a fastening device composed of a surface fastener which includes, as shown here in FIG. 8, a, pair of cushioning members of sponge or foamed plastics disposed on one surface of a foundation fabric along opposite longitudinal edges thereof such that the cushioning members are normally higher than interlocking elements, such as loops or hooks, and become smaller in height than the interlocking elements when they are compressed.

According to the first-mentioned example of known surface fastener, the waterproof members of synthetic resin or rubber are woven into the opposite longitudinal edges of the foundation fabric to form thick and bulky longitudinal edge portions so as to provide a waterproof design to the surface fastener. To this end, the thick and bulky longitudinal edge portions must project beyond an outer end of the interlocking elements, and so the interlocking elements are unable to engage with the mating interlocking elements with sufficient stability. Another problem is that the surface fastener has no particular mounting portion and hence cannot be readily attached to an article by a sewing means.

The second-mentioned example of known surface fastener cannot be manufactured by a single operation and hence is expensive to manufacture because the woven or knitted core members are sewn to the longitudinal edges of the foundation fabric after the foundation fabric including the interlocking elements is manufactured. Due to the absence of a mounting portion, the surface fastener requires a tedious sewing operation when it is attached to an article by a sewing means.

The third-mentioned example is a fastening device composed of a known surface fastener including the cushioning members of sponge or foamed plastic disposed on the opposite edges of one surface of the foundation fabric, and it cannot prevent a crushing of the interlocking elements, such as loops or hooks, when the surface fastener is subjected to ironing, for example. The fastening device composed of the surface fastener cannot be attached to an article by a sewing means and, hence, has a limited scope of application.

SUMMARY OF THE INVENTION

With the foregoing drawbacks in view, an object of the present invention is to provide a surface fastener which is capable of preventing a crushing of interlocking elements, such as loops, hooks, or the mushroom-typed when subjected to a pressure during ironing, for example, which can retain a strong engagement between two companion fastener parts and hence is applicable to various fields of use, which can be readily attached to an article by a sewing means, and which can be manufactured by a single operation and hence inexpensive to manufacture.

To attain the foregoing object, the present invention provides a surface fastener which comprises: a woven fabric having a number of interlocking elements projecting from one surface of the woven fabric; at least one round cord disposed adjacent to the interlocking elements, the round cord being woven at regular intervals as the woven fabric is woven in such a condition that the round cord is longitudinally tensed to have a height smaller than the height of the interlocking elements and disposed in a exposed condition on the surface of the woven fabric. And a flat attachment portion is disposed on an outer side of the round cord where no interlocking elements are provided.

The surface fastener may have a single-row structure in which two round cords are disposed on opposite sides of one group of interlocking elements projecting from the surface of the woven fabric. Alternatively, the surface fastener may have a multi-row structure in which a plurality of groups of interlocking elements are disposed alternately with a plurality of round cords.

In one preferred form of the invention, each of the round cords is woven, as the woven fabric is woven, with a warp yarn (hereafter called "a binding yarn") under tensed condition such that the round cord is disposed in an exposed condition on the surface of the woven fabric.

In another preferred form of the invention, each of the round cords is woven with a weft yarn of the woven fabric while the round cord is in tensed condition such that the round cord is disposed in an exposed condition on the surface of the woven fabric.

The round cord is preferably composed of a braid or a knitted cord.

With this arrangement of the surface fastener of the present invention, since the round cord is disposed in an exposed condition on a surface of the woven fabric adjacent to the interlocking elements, and since the round cord is woven under tensed condition, the round cord is rigid and is highly resistant to compression or crush. Accordingly, in the case where the surface fastener is used on a pillow cover of a vehicle seat, the round cord is able to prevent a crushing of the interlocking elements even when the surface fastener is subjected to wringing or ironing after the pillow cover is laundered. The interlocking elements kept free from crushing are able to provide a great fastening strength over a prolonged period of use. By using the flat attachment portion provided on the outer side of the round cord, the surface fastener can be readily attached to an article. The flat attachment portion may be omitted.

The above and other objects, features and advantages of the present invention will become manifest to those versed in the art upon making reference to the detailed description and the accompanying sheets of drawings in which preferred structural embodiments incorporating the principles of the present invention are shown by way of illustrative example.

DETAILED DESCRIPTION

Certain preferred embodiments of the present invention will be described below in greater detail with reference to the accompanying drawings.

Figure 1:
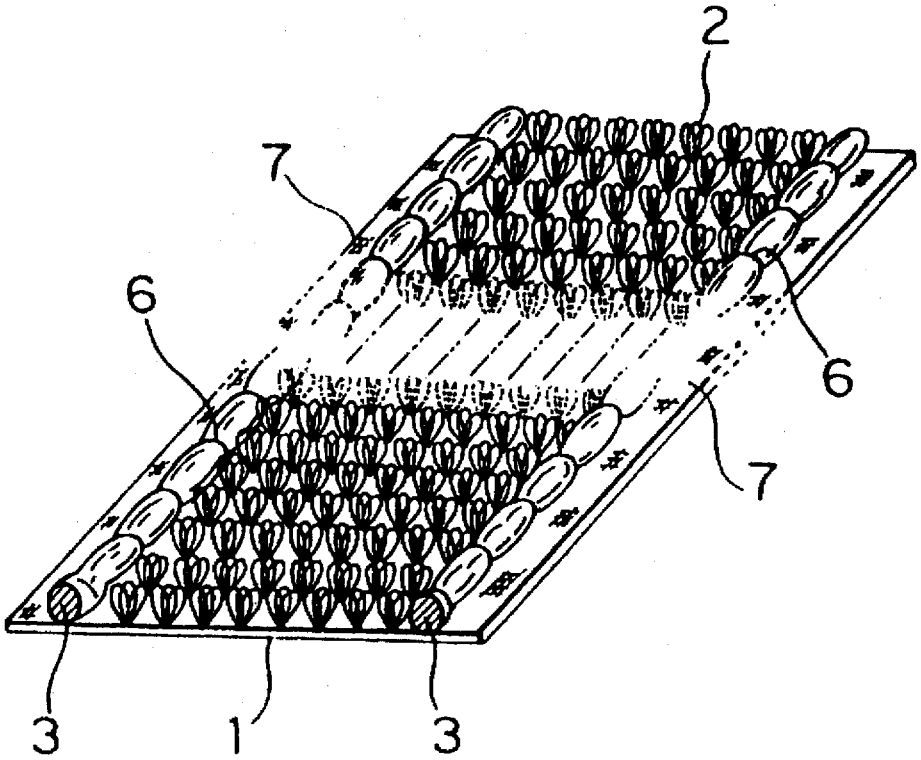
FIG. 1 is a schematic perspective view of a surface fastener according to one embodiment of the present invention.
Figure 2:
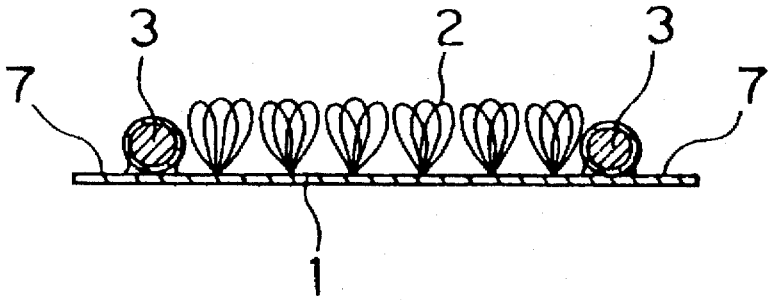
FIG. 2 is a transverse cross-sectional view of the surface fastener.
Figure 3:
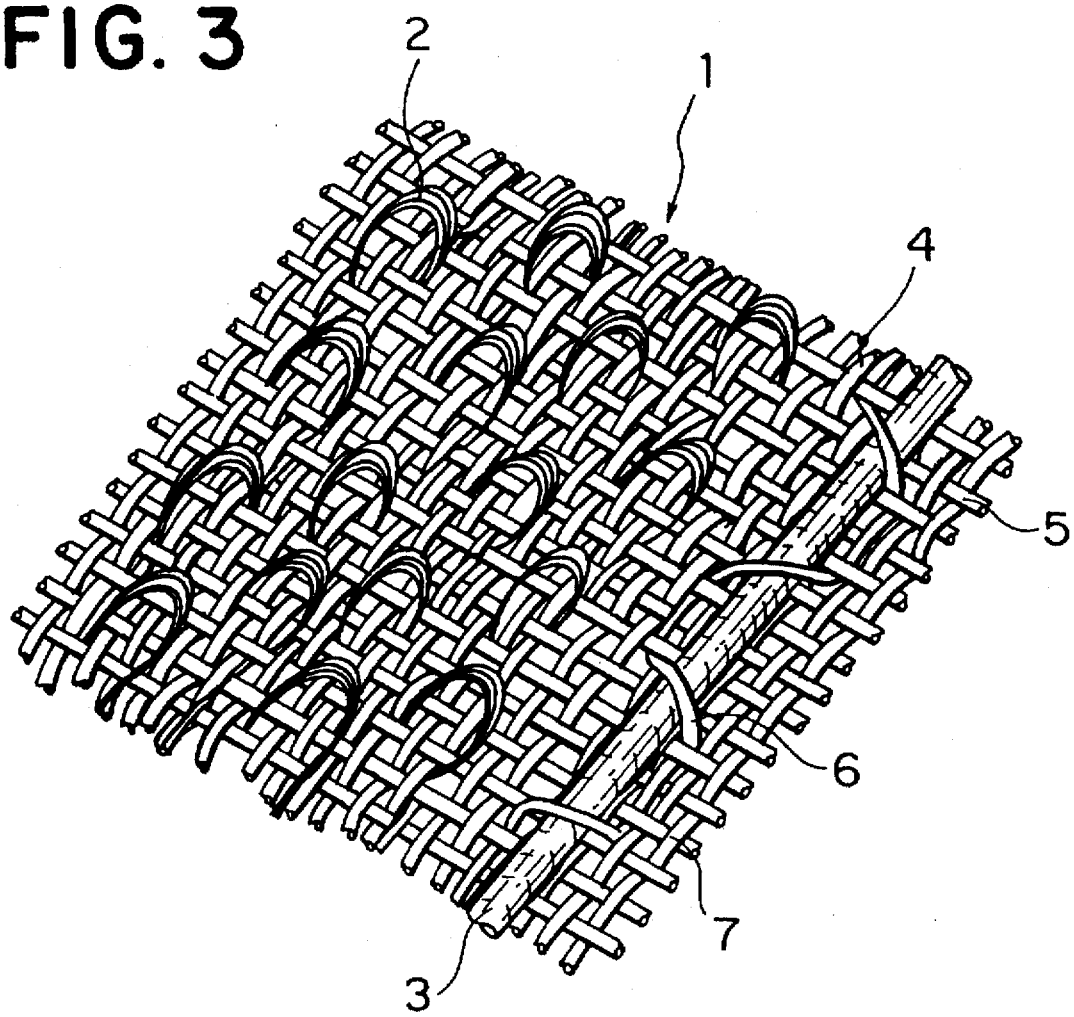
FIG. 3 is a perspective view of a main portion of the surface fastener having a round braid woven into a woven fabric by a binding yarn.

A surface fastener according to a first embodiment of the present invention includes, as shown in FIGS. 1 and 2, a woven fabric 1 having a mass of interlocking elements 2, such as hooks or loops (as in the illustrated embodiment), projecting from one surface of the woven fabric 1, and a pair of round cords 3, 3 disposed on the surface of the woven fabric 1 adjacent to opposite longitudinal edges of the mass of interlocking elements 2. The round cords 3, 3 are composed of a braid or a knitted cord and arranged in such a manner as shown in FIG. 3. As shown in FIG. 3, the woven fabric 1 is woven of warp yarns 4 and a weft yarn 5, and at the time of weaving, the round cords 3 are prepared as warp yarns and each is woven under constant tension by binding with a binding yarn 6 at regular intervals in such a condition that the round cords 3 are disposed in an exposed condition on the surface of the woven fabric 1 and hence able to prevent a crushing of the interlocking elements 2. The interlocking elements 2 may have an arrangement composed of a mixture of hooks and loops.

The woven fabric 1 has a flat longitudinal edge portion devoid of interlocking elements 2 and disposed in juxtaposition with each of the round cords 3 on an outer side of the round cord 3 where no interlocking elements 2 are provided. The flat longitudinal edge portion of the woven fabric 1 constitutes an attachment portion 7 which can be used for facilitating attachment of the surface fastener to an article by the use of a sewing means. The flat attachment portion 7 is formed at the same time as the woven fabric 1 is woven.

Figure 4:
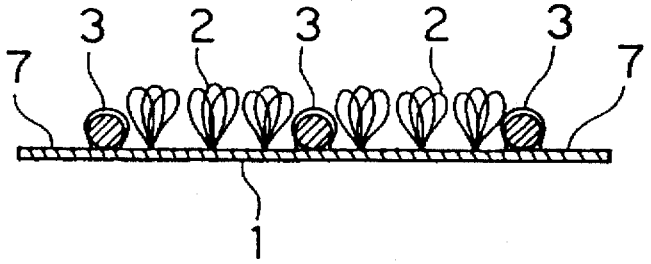
FIG. 4 is a transverse cross-sectional view of a surface fastener including an alternation of interlocking element groups and round braids according to another embodiment of the present invention.

As shown in FIG. 4, the surface fastener may have a multi-row structure including a plurality (two being shown) of laterally spaced groups of interlocking elements 2 arranged alternately with a plurality (three being shown) of round cords 3 woven into the woven fabric 1. The multi-row structure is particularly suitable for use in a wide use in a wide surface fastener. The round cords 3 are woven into the woven fabric 1 at desired transverse intervals which may be regular or irregular.

The interlocking elements 2 composed of hooks or loops, the round cords 3, the warp yarns 4, the weft yarn 5, and the binding yarns 6 all used in the surface fastener are formed from a multifilament yarn or a monofilament yarn of synthetic fiber such as polyamide or polyester. The round cords are composed of a braid or a knitted cord, as described above, and more particularly, a round braid is preferable.

Figure 5:
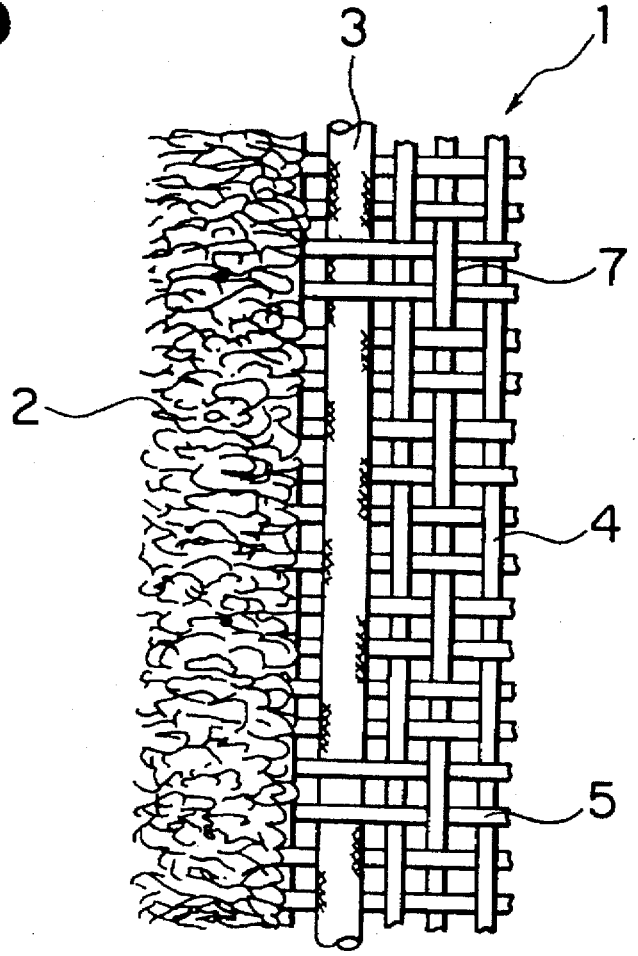
FIG. 5 is a plan view of a main portion of a surface fastener according to a further embodiment of the present invention.
Figure 6:
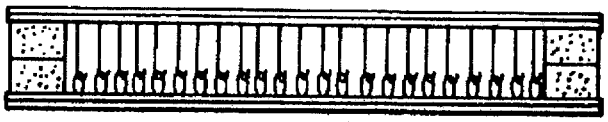
FIG. 6 PRIOR ART
FIG. 6 is a transverse cross-sectional view of a conventional surface fastener.
Figure 7:
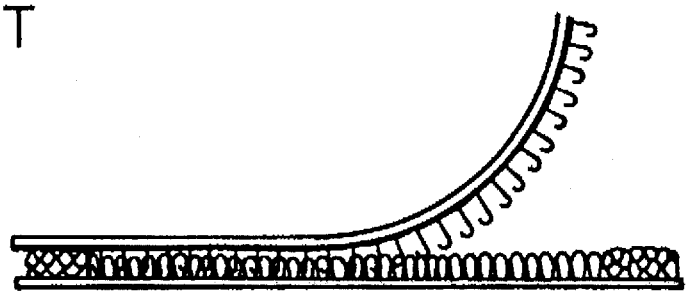
FIG. 7 PRIOR ART
FIG. 7 is a transverse cross-sectional view of another known surface fastener.
Figure 8:
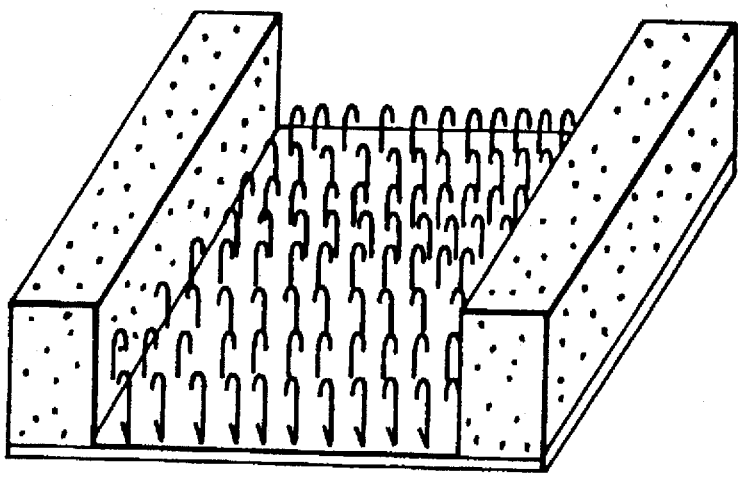
FIG. 8 PRIOR ART
FIG. 8 is a schematic perspective view of still another known surface fastener.

FIG. 5 shows a modified form of the surface fastener in which a round cord 3 is woven directly with a weft yarn 5 at regular intervals as a woven fabric 1 is woven on a needle loom. During the weaving process, the round cord 3 is prepared as a warp yarn and woven under tensed condition so that the round cord 3 is disposed in an exposed condition on a surface of the woven fabric 1 and hence capable of preventing a crushing of the interlocking elements 2 composed of hooks or loops. At the same time, a flat attachment portion 7 devoid of interlocking elements 2 is formed on an outer side of the round cord 3 opposite to the interlocking elements 2.

By virtue of the structural features described above, the surface fasteners of the present invention have various advantages enumerated below.

Since the round cords of the surface fastener are woven at regular intervals into the woven fabric along opposite longitudinal edges of a group of interlocking elements on the woven fabric in such a condition that the round cords are tensed and have a smaller height than the interlocking elements, the round cords are made rigid and highly resistant to compression or crush. The round cords are, therefore, possible to withstand a wringing operation and an ironing operation done after laundering. With the round cords thus provided, the interlocking elements are completely protected against crush and able to provide a great fastening strength over a prolonged period of use.

By virtue of the flat attachment portions disposed on an outer side of the round cords, the surface fastener of this invention can be readily and accurately and moreover neatly attached by sewing to an article by using the attachment portion rather than the interlocking elements used for sewing purposes in the case of a conventional surface fastener.

In this invention, the flat attachment portion may be omitted. In such a case, the surface fastener of this invention can be secured onto the article using an adhesive agent.

Furthermore, since the round cords are woven into the woven fabric as the latter is woven, the surface fastener of the present invention can be manufactured by a single weaving operation which will bring a certain reduction in manufacturing cost. The surface fastener of this invention can, therefore, be manufactured at a low cost.

The surface fastener of this invention may have a single-row structure in which two round cords are disposed on opposite sides of a group of interlocking elements, which structure is particularly useful when embodied in a narrow surface fastener because the interlocking elements are fully protected against compression or crush by means of the round cords. As an alternative, the surface fastener may also have a multi-row structure in which a plurality of laterally spaced groups of interlocking elememts are disposed alternately with a plurality of round cords, which structure is particularly useful when the surface fastener is deformed in the transverse direction, and especially when it is applied for a wide surface fastener, the round cords are able to provide a sufficient protection to the interlocking elements against crush.

During the weaving process, the round cords are arranged as warp yarns and woven under tensed condition with binding yarns or a weft yarn so that the round cords are disposed in exposed condition on a surface of the woven fabric. The round cords thus arranged only requires a simple weaving operation and can provide aesthetical appearance to the surface fastener.

Furthermore, as the round cord is composed of a braid or a knitted cord, it can be manufactured with no difficulty. In addition, since the round cords are composed of the same material as the woven fabric and hence fit well with the woven fabric, a weaving operation can be achieved smoothly and reliably.

The shape of the interlocking elements of the invention is not limited to the hooks or loops and it may be a mushroom shape.

Obviously, various minor changes and modifications of the present invention are possible in the light of the above teaching. It is therefore to be understood that within the scope of the appended claims the invention may be practiced otherwise than as specifically described.

What is claimed is:

1. A surface fastener comprising:

a woven fabric having a number of interlocking elements projecting from one surface of said woven fabric within an area; and at least two round cords disposed adjacent to said interlocking element and located along sides of said area, said round cords being woven into said woven fabric, in such a condition that said round cords are longitudinally tensed and have a height smaller than the height of said interlocking elements and are disposed in an exposed condition on said surface of said woven fabric.

2. A surface fastener according to claim 1, wherein said fabric includes flat attachment portions on said one surface thereof, disposed on outer sides of said round cords where no interlocking elements are provided.

3. A surface fastener according to claim 1, wherein said round cord is composed of a braid or a knitted cord.

4. A surface fastener according to claim 3, wherein each of said round cords is woven into said fabric at regular intervals with a binding yarn under tensed conditions such that the round cord is disposed in an exposed condition on said one surface of said woven fabric.

5. A surface fastener according to claim 3, wherein each of said round cords is woven into said woven fabric with a weft yarn of said woven fabric under tensed condition such that the round cord is disposed in an exposed condition on said one surface of said woven fabric.

6. A surface fastener according to claim 1, wherein said at least two round cords comprises two round cords being disposed on opposite sides of said area on said one surface of said woven fabric, and said fabric includes flat attachment portions on said one surface thereof, said attachment portions being disposed on outer sides of said round cords.

7. A surface fastener according to claim 6, wherein each of said round cords is woven into said woven fabric at regular intervals with a binding yarn under tensed conditions such that the round cord is disposed in an exposed condition on said one surface of said woven fabric.

8. A surface fastener according to claim 6, wherein each of said round cords is woven into said woven fabric with a weft yarn of said woven fabric under tensed condition such that the round cord is disposed in an exposed condition on said one surface of said woven fabric.

9. A surface fastener according to claim 1, wherein said interlocking elements projecting from said one surface of said woven fabric are composed of a plurality of groups of interlocking elements disposed alternately with a plurality of said round cords, and said woven fabric includes flat attachment portions on said one surface thereo,f said attachment portions being disposed adjacent to two outermost ones of said round cords on outer sides thereof.

10. A surface fastener according to claim 1, wherein each of said round cords is woven into said woven fabric at regular intervals with a binding yarn under tensed conditions such that the round cord is disposed in an exposed condition on said one surface of said woven fabric.

11. A surface fastener according to claim 1, wherein each of said round cords is woven into said woven fabric with a weft yarn of said woven fabric under tensed condition such that the round cord is disposed in an exposed condition on said one surface of said woven fabric.

* * * * *